United States Patent [19]

Davis et al.

[11] 4,137,624

[45] Feb. 6, 1979

[54] APPARATUS FOR INSERTING WIRES INTO TERMINALS IN A CONNECTOR

[75] Inventors: Newton G. Davis, Harrisburg; James W. Hammond, Camp Hill; Phillip E. Loomis, Harrisburg, all of Pa.

[73] Assignee: AMP Incorporated, Harrisburg, Pa.

[21] Appl. No.: 846,732

[22] Filed: Oct. 31, 1977

[51] Int. Cl.[2] ..... H01R 43/00

[52] U.S. Cl. ..... 29/566.1; 29/33 M; 29/749; 29/753

[58] Field of Search ..... 29/566, 566.1, 566.2, 29/33 M, 33 L, 749, 753, 628

[56] References Cited

U.S. PATENT DOCUMENTS

| | | | |
|---|---|---|---|
| 3,936,933 | 2/1976 | Folk et al. | 29/749 X |
| 4,043,017 | 8/1977 | Folk et al. | 29/749 |

*Primary Examiner*—Gil Weidenfeld
*Attorney, Agent, or Firm*—Frederick W. Raring

[57] ABSTRACT

Apparatus for connecting the ends of a plurality of wires to the terminals in a connector comprises a press having a reciprocating ram and insertion tooling on the ram for inserting the wires into terminals in a connector located in an insertion zone beneath the ram. The wires are presented to the insertion zone by means of a slide member which is movable between a loading station, which is beside the insertion zone, and an insertion station. Connectors are delivered to the insertion zone during each operating cycle by a connector feeding means. The apparatus is of the manually assisted type in that an operator need only place the wires on the slide while it is at the loading station.

13 Claims, 12 Drawing Figures

130
140
120
116
118
128
20
124
110
142
106
104
144
126
98
148
100
112
102
48
146
92
88
78
96
84
54
82
80
10
70
52
74
72
26
56

162
168
170
172
164
66
86
154
68
142
160
10
156
166
174
42
44
198
194
184
50
192
44
48
51
183
190
52
188
62
34
34
58
64
52
32
5

APPARATUS FOR INSERTING WIRES INTO TERMINALS IN A CONNECTOR

BACKGROUND OF THE INVENTION

This invention relates to apparatus for simultaneously connecting each of a plurality of wires to the individual terminals contained in an electrical connector or the like. The herein disclosed embodiment of the invention comprises a manually assisted cable making machine which attaches the wires in a cable to the terminals in a connector, however, the principles of the invention can be used in other types of apparatus such as fully automatic cable making machines.

U.S. Pat. No. 3,760,335 discloses and claims a multicontact electrical connector having contact terminals therein, each contact terminal having a wire-receiving portion which receives and establishes electrical contact with a wire upon movement of the wire laterally of its axis and into the wire-receiving portion of the terminal. This patent also discloses one class of apparatus for simultaneously inserting each of a plurality of wires into the terminals in the connector. The type of electrical connection between the wire and the terminal is commonly referred to as a "displation" type connection for the reason that the insulation of the wire is displaced during movement of the wire into the terminal to permit and establish the electrical connection between the wire and the terminal.

The connector shown in U.S. Pat. No. 3,760,335 has received widespread acceptance in the industry and its success has inspired the development of other multicontact connectors having displation type terminals therein as shown, for example, in U.S. Pat Nos. 4,043,034 and 4,043,017 and in application Ser. No. 794,429 filed May 6, 1977. A particularly attractive feature of connectors having these displation type contact terminals therein is that a plurality of wires can be connected simultaneously to the terminals in the connector and the time required to produce a wired connector is, therefore, greatly reduced. U.S. Pat. Nos. 4,043,034 and 4,043,017 disclose cable making machines which have the capability of producing electrical cables having connectors at their ends, each cable containing a plurality of individual wires. Such cable making machines are being used to an increasing extent in the electrical industry and find high favor by virtue of the speed with which they can produce cables and harness sub-assemblies.

The instant invention is directed to the achievement of a cable making apparatus which expands the range of usefulness of displation type connectors and which permits the use of such connectors under circumstances where their use was heretofore somewhat impractical. Particularly, the invention is directed to the achievement of a relatively compact manually assisted apparatus for attaching connectors to each end of a previously cut cable. The apparatus comprises an insertion zone having means therein for locating one or more multicontact electrical connectors and insertion punches which insert wires presented to the insertion zone into the terminals into the connector. The wires are presented to the insertion zone by means of a slide member which is movable between a loading station and an insertion station during each operating cycle of the apparatus. The operator need only load a cable on the slide and actuate the apparatus by closing a switch and the other functions of the apparatus are fully automatic. Certain features of the apparatus described in detail below permit operation at a relatively high rate by an operator who need not necessarily be highly trained.

It is accordingly an object of the invention to provide an improved apparatus for inserting wires into the terminals on a connector. A further object is to provide an apparatus having an insertion zone and having means for carrying connectors and wires to the insertion zone during each operating cycle in preparation for insertion of the wires into the terminals of the connector. A further object is to provide a relatively compact manually assisted apparatus which can be used for a wide variety of cable manufacturing and harness manufacturing operations.

These and other objects of the invention are achieved in one preferred embodiment thereof which is briefly described in the foregoing abstract, which is described in detail below, and which is shown in the accompanying drawing in which.

Figure 9:
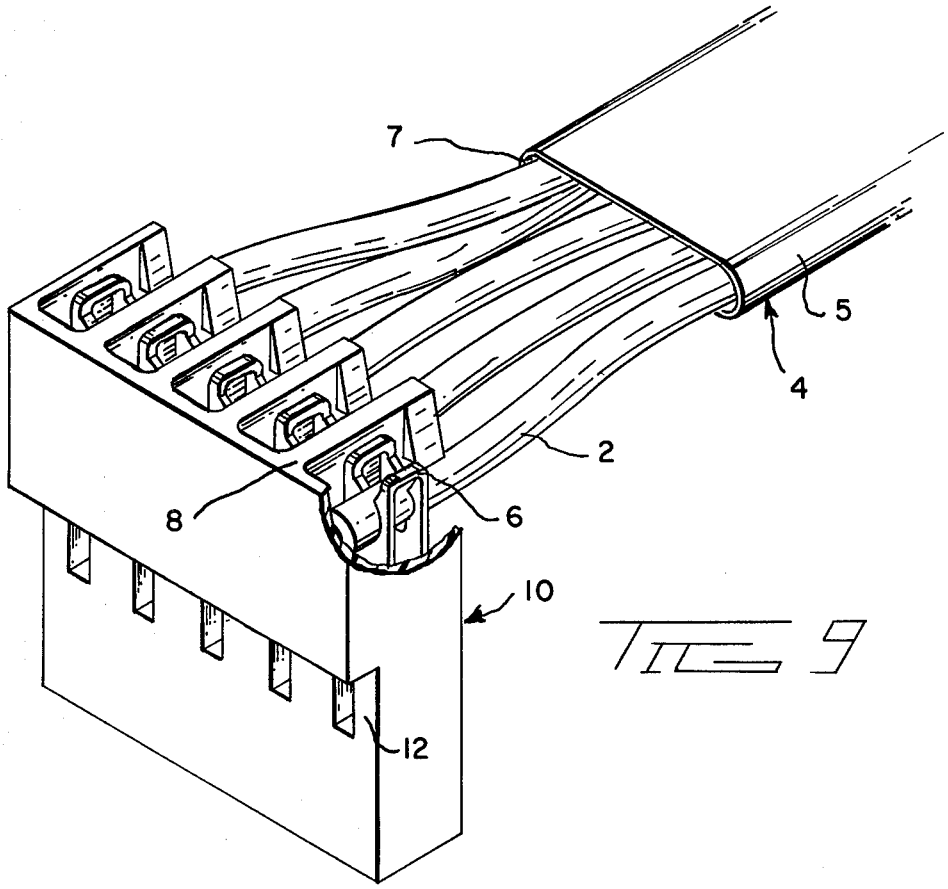
FIG. 9 is a perspective view of a connector installed on one end of a cable.
Figure 8:
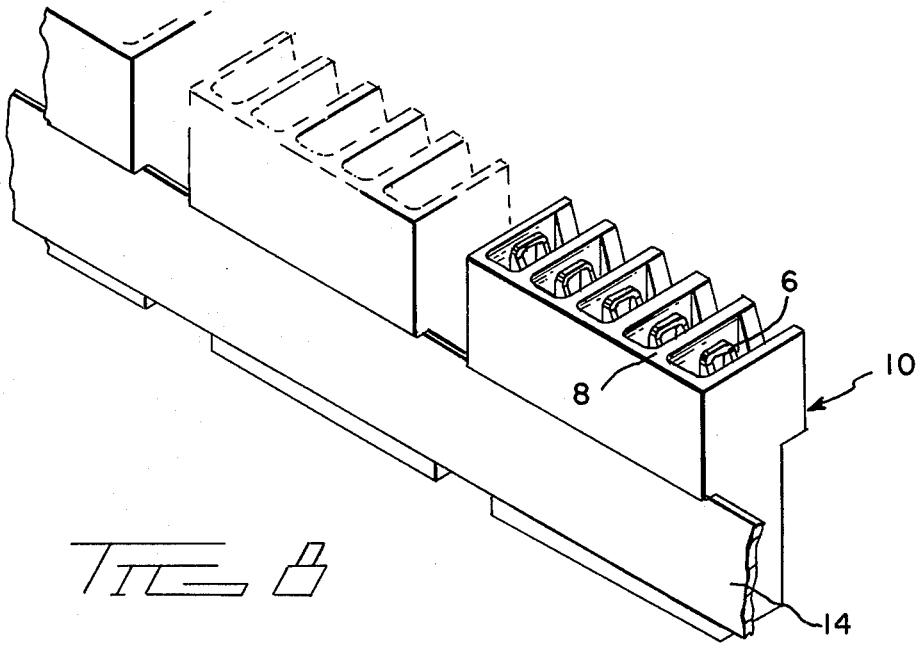
FIG. 8 is a perspective view showing a portion of a continuous strip of electrical connectors of the type for which the disclosed embodiment is intended.

The embodiment of the invention disclosed herein serves to connect the wire 2 of a cable 4 (FIG. 9) to the wire-receiving portion 6 of side-by-side terminals in a connector housing 10. The housing is generally prismatic as shown and the wire-receiving portions 6 of the terminals are adjacent to the upper end 8 of the housing, the electrical connections being made by moving the wires laterally of their axes and downwardly as viewed in FIG. 9 into the wire-receiving portions of the terminals. Each housing has a recess 12 on its face and is secured by bonding or otherwise to a continuous tape or belt 14 which is disposed against the recess surface 12. Advantageously, at the time of manufacture, the continuous tape 12 is wound on a reel and the apparatus described below has means for feeding individual connectors from the reel to the operating zone.

The apparatus comprises a bench press 16 having a frame including an upper arm 18, a vertically extending neck portion 20, and a lower arm 22. A reciprocable ram 24 is contained in the upper arm and moves downwardly into the insertion zone which is beneath the tooling mounted on the ram during each operating cycle. The press may be of any suitable type and in the instant embodiment, is constructed such that the ram 24 goes through one complete cycle of movement towards and away from the insertion zone when a suitable control switch is closed. For example, the press can be of the type having a flywheel and a single revolution clutch for coupling the press ram to the flywheel as disclosed generally in FIG. 4 of U.S. Pat. No. 3,046,636.

Figure 1:
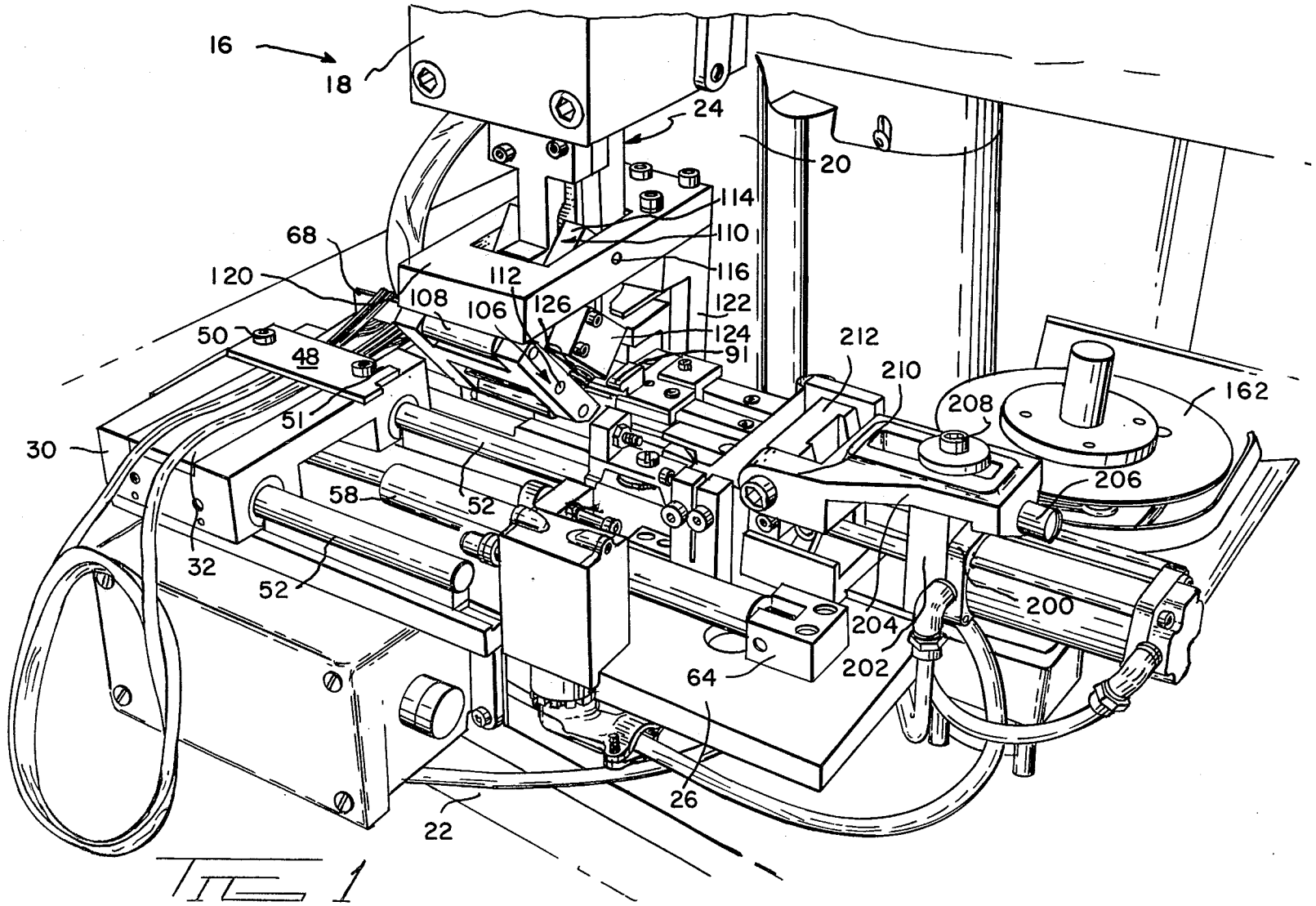
FIG. 1 is a perspective view of the operating zone of a preferred form of apparatus in accordance with the invention.

A mounting plate 26 is secured to the lower arm 22 of the press and the reel of connectors is mounted on a suitable spindle which is disposed to the right, as viewed in FIG. 1 of this mounting plate. The operating or insertion zone of the apparatus is located centrally on the mounting plate adjacent to the neck portion 20 of the press frame and immediately beneath the press ram 24.

Figure 3:
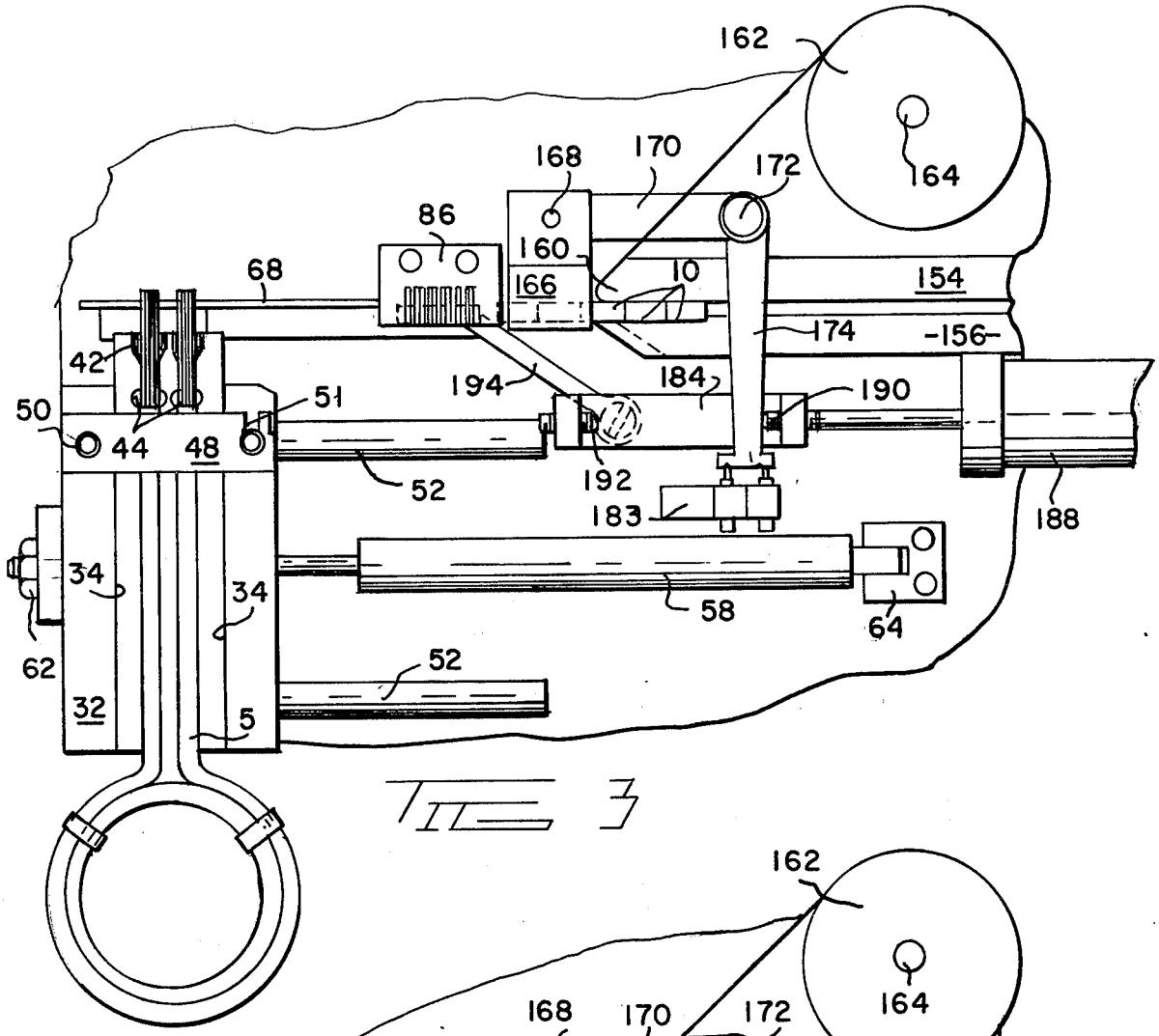
FIG. 3 is a fragmentary plan view of the operating zone showing the slide member at its loading station.

The ends of a cable 4 to which connectors 10 are to be applied are carried and presented to the insertion zone by a slide block 30 having a cable holding and positioning templet plate 32 on its upper surface. A pair of side-by-side channel shaped recesses 34 extend inwardly from the outer end 36 of the templet plate towards the inner end 38 thereof, these recesses being of a width sufficient to receive the jacket portion 5 of the cable as shown in FIG. 3. The recesses 34 extend to enlarged recesses 44 which are adjacent, but spaced from, the end 38 of the templet plate and individual side-by-side parallel grooves 40 extend from the enlarged recess portion 44 towards the end 38 of the plate. The grooves 40 are dimensioned snuggly to receive the individual wires 2 of the cable and these grooves diverge as shown at 42 adjacent to the end 38 so that wires positioned in these grooves will be spaced-apart by distances corresponding to the spacing between adjacent terminals 6 in a connector 10.

A suitable clamping means is provided for clamping the end portions of the cable in the recess 34 in the form of a simple clamping plate 50 which is pivoted at 52 to the slide member 30 and which can be swung in a clockwise direction from the position shown in FIG. 3 to permit removal of the cable from the templet plate, a pin and slot arrangement 51 being provided as shown latching the clamping plate in its clamping position as shown in FIG. 3.

The slide member 30 is shown in FIG. 3 in its loading station at which the operator places the cable 4 on the templet plate 32 at the beginning of an operating cycle. It will be noted that the end portions 46 of the wires extend above a camming block 66 which is mounted on the plate 26 and above the upper edge of a realtively thin wire positioning plate 68 which is disposed beside the camming block 66. The plate 68 supports the ends of the wires in an elevated condition when they are delivered to the insertion zone for reasons which will become apparent as this description proceeds.

Figure 4:
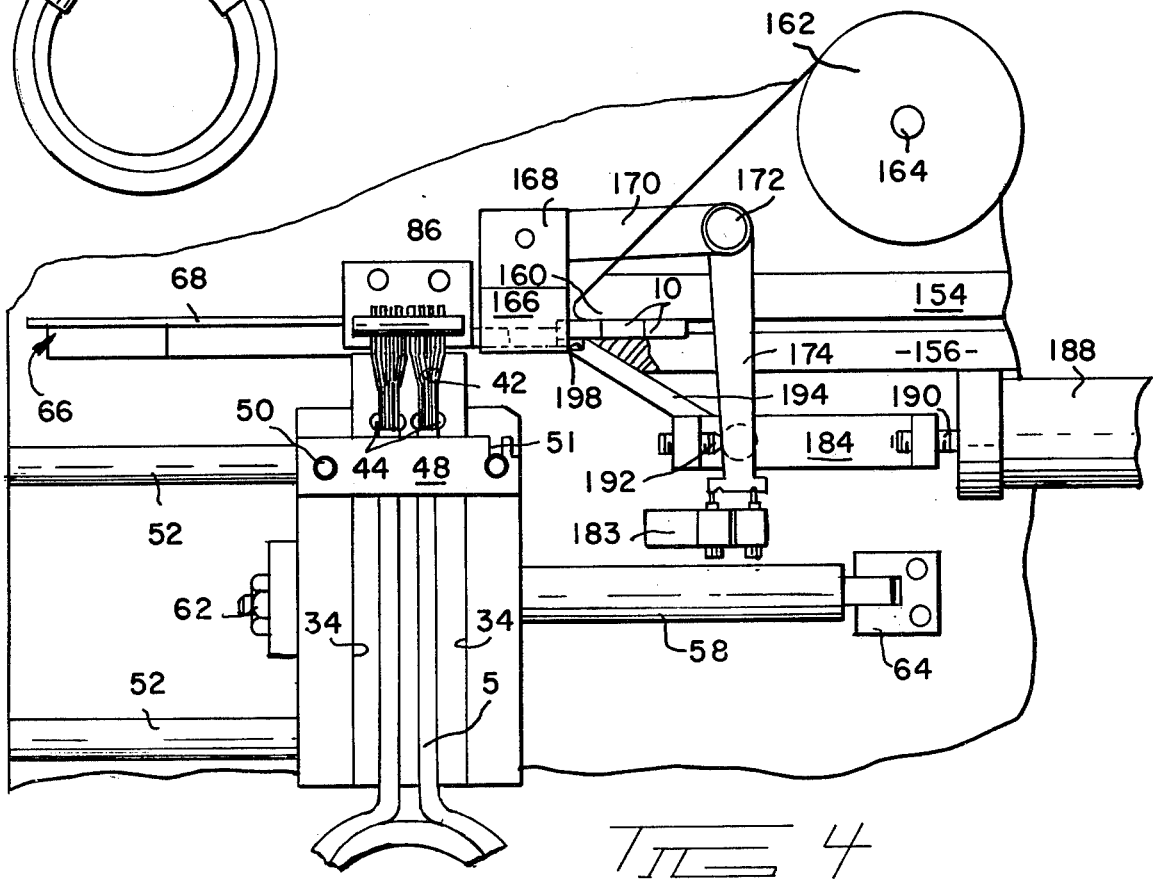
FIG. 4 is a view similar to FIG. 3 showing the positions of the parts after the slide member has moved to the insertion station.
Figure 5:
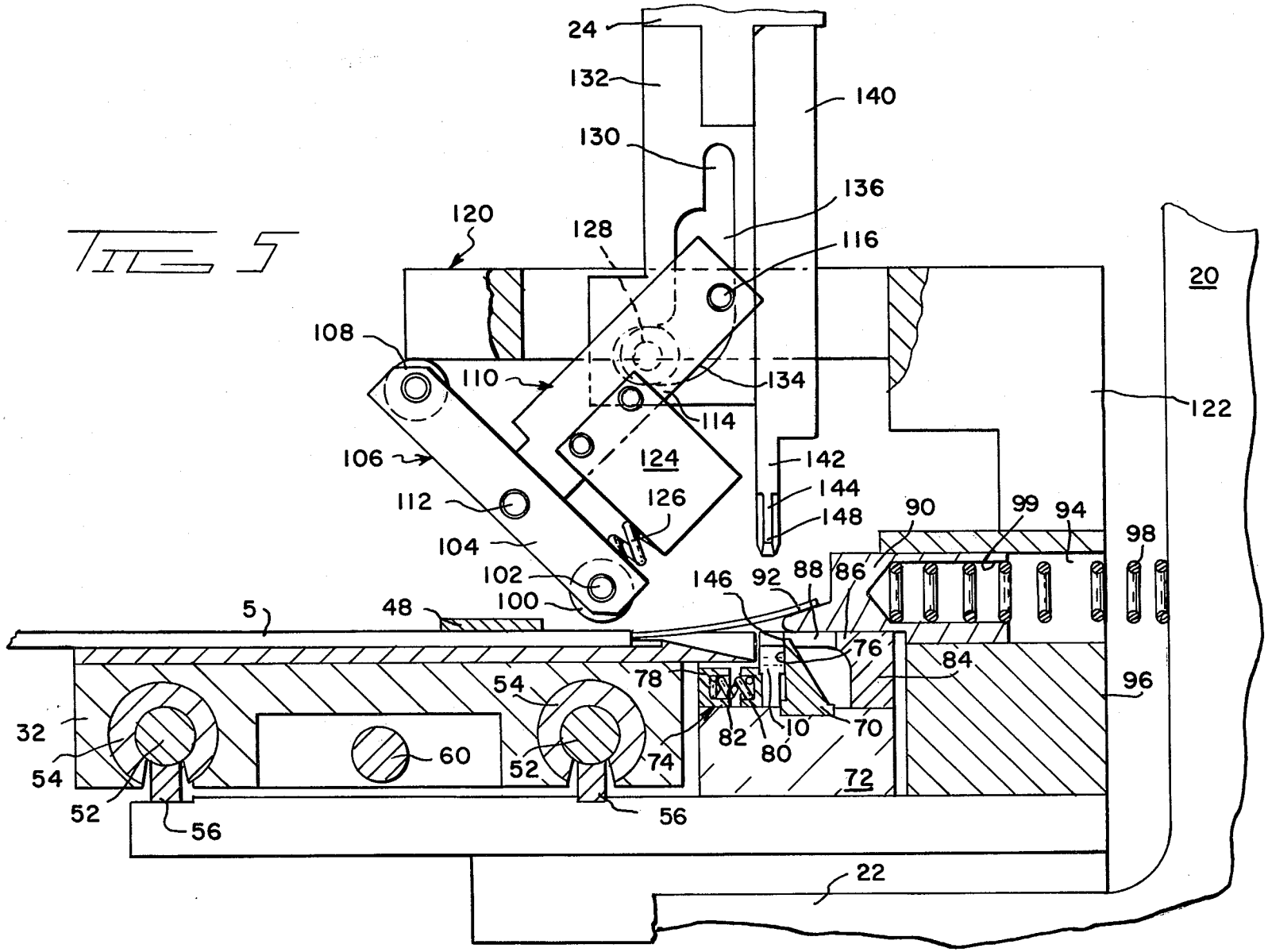
FIG. 5 is a fragmentary side view, partly in section, taken through the operating zone of the apparatus showing the positions of the parts after arrival of the slide member at the insertion station and prior to descent of the ram.

As shown in FIG. 5, slide block 30 is slidably mounted on parallel rails 52 which are supported above the surface of the mounting plate 26 by suitable support rails 56. The slide block has cylindrical recesses extending therethrough in which bearing bushings 54 are mounted and the rails 52 extend through these bushings. The rails 52 extend rightwardly as viewed in FIG. 3 to a location which is in front of the insertion zone so that upon rightward movement of the slide block 30 from the position of FIG. 3 to the position of FIG. 4, the ends of the wires 46 are carried to the insertion zone. Reciprocation of the slide block 30 between its loading station and its insertion station is accomplished by a piston-cylinder 58, 60 the piston rod being connected as shown at 62 to the slide block. The cylinder 58 is suitably anchored by means of a bracket 64 to the upper surface of the mounting plate 26.

A positioning and shearing block 70 is mounted in the insertion zone on a support plate 72 which is in turn mounted on the base plate 26. The positioning block 70 has a leftwardly facing surface 76, as viewed in FIG. 5, and the previously fed connectors 10 are held against this surface by a clamping means 74 comprising one part 78 which is secured to the base block 72 and a slidable part 80 which is biased towards the surface 76 by spring means 82 which are interposed between recesses in the two parts of the clamp.

A fixed templet means 84 is also mounted on the base block 72 in the insertion zone and has leftwardly extending (as viewed in FIG. 5) spaced-apart cantilever arms 86, the spacing between the arms 86 defining slots 88 which are dimensioned to receive the wires 2. The upper end of the shearing block 70 is notched, as is apparent from FIG. 5, to receive the arms 86 and these upper ends also serve as fixed shearing edges for the wires which cooperate with movable shearing edges on the inserter 140.

A wire end controller 90 is normally positioned on the upper or first surface of the fixed templet block 84 and extends over the slots 88. This controller has an inclined front surface 92 at its free end which serves to support the ends of the wires 2 when the parts are in the position of FIG. 5 and to ensure that the wires will be properly located in the terminals in the connector. It will be apparent from the drawings that the controller 90 must move rightwardly from the position of FIG. 5 during insertion of the wires and such rightward movement is permitted by virtue of the fact that the controller is slidably received in a recess 94 in a mounting block 96. Controller 90 is biased to the position shown in FIG. 5 by a spring 98 which bears against a fixed surface at its right hand end and which extends into a recess 99 in the controller.

After the slide 30 has moved from the loading station to the insertion station (FIGS. 4 and 5), the individual wires 2 are rolled or pressed into the wire-receiving grooves 40 in the upper surface of the templet plate 32 and as the wires are pressed into the divergent portions 42 of these grooves, they are spread apart so that they are spaced from each other by distances corresponding to the spacing between adjacent terminals in the connectors 10. This wire rolling technique has been previously described, for example, in U.S. Pat. Nos. 3,936,933 and 3,887,999. The roller 100 for rolling the wires is mounted between the arms 104 of a generally H-shaped carrier 106, the roller having reduced ends 102 which are received in the arms at the lower end of the carrier as shown in FIG. 5. A second roller 108 is mounted between the arms of the carrier at the upper end thereof and this roller bears against the underside of an upper frame plate 120, the purpose of this roller 108 being simply to reduce the friction between the frame plate and the carrier.

Carrier 106 is pivotally mounted intermediate its ends as shown at 112 on the lower end of a yoke member 110 having spaced-apart arms 114 which extend into a rectangular opening 118 in an upper frame plate 120. The upper ends of the arms 114 are pivoted as shown at 116 to the frame plate so that the entire assembly, including the yoke 110 and the carrier 106, can be swung counterclockwise from the position shown in FIG. 5. The upper frame plate 120 extends towards the neck portion 20 of the press and is supported on a support block 122 which extends from, and is secured to, the mounting plate 26.

The carrier 106 is resiliently biased in a clockwise direction relative to its pivotal axis 112 by springs 126 which are effective between the arms 104 of the carrier and plates 124 which are fastened to the arms of the yoke and which extend beside the lower ends of the arms 104. This arrangement permits the carrier 106 to pivot through a limited counterclockwise arc when the carrier moves downwardly towards and across the templet plate 30.

The movements of the yoke 110 during descent of the ram 104 are controlled by a cam roller 128 which extends between the arms 114 of the yoke 110 and which is received in a cam slot 134, 136, and 138 which is provided in a camming block 132 on the lower end of the press ram 24. The cam slot in this camming block has a lowermost portion 134 which extends substantially horizontally for a very short distance and then it curves upwardly to the vertically extending portion 136. The reduced width upper end 138 of the recess or opening is provided for the accommodation of the pivot pin 116 by means of which the yoke 110 is pivoted to the upper frame plate 120.

It will be apparent from an inspection of FIG. 5 and from the other drawings that as the ram 24 moves downwardly, the assembly comprising the carrier 106 and the yoke 110 will initially move downwardly until the roller 100 is against the surface of the templet plate 32. Upon further downward movement of the ram, the yoke 110 will swing through a slight counterclockwise arc and the carrier 106 may also swing through a clockwise arc relative to its pivotal axis 112. During this interval, the roller 100 will move across the upper surface of the templet plate and roll the wires into the grooves or recesses 40, 42. It will be noted from FIG. 5 that the portions 42 of the recesses slope downwardly towards the previously fed connectors 10 so as to permit the wires to enter the wire-receiving portions 6 of the terminals in the connectors.

Figure 6:
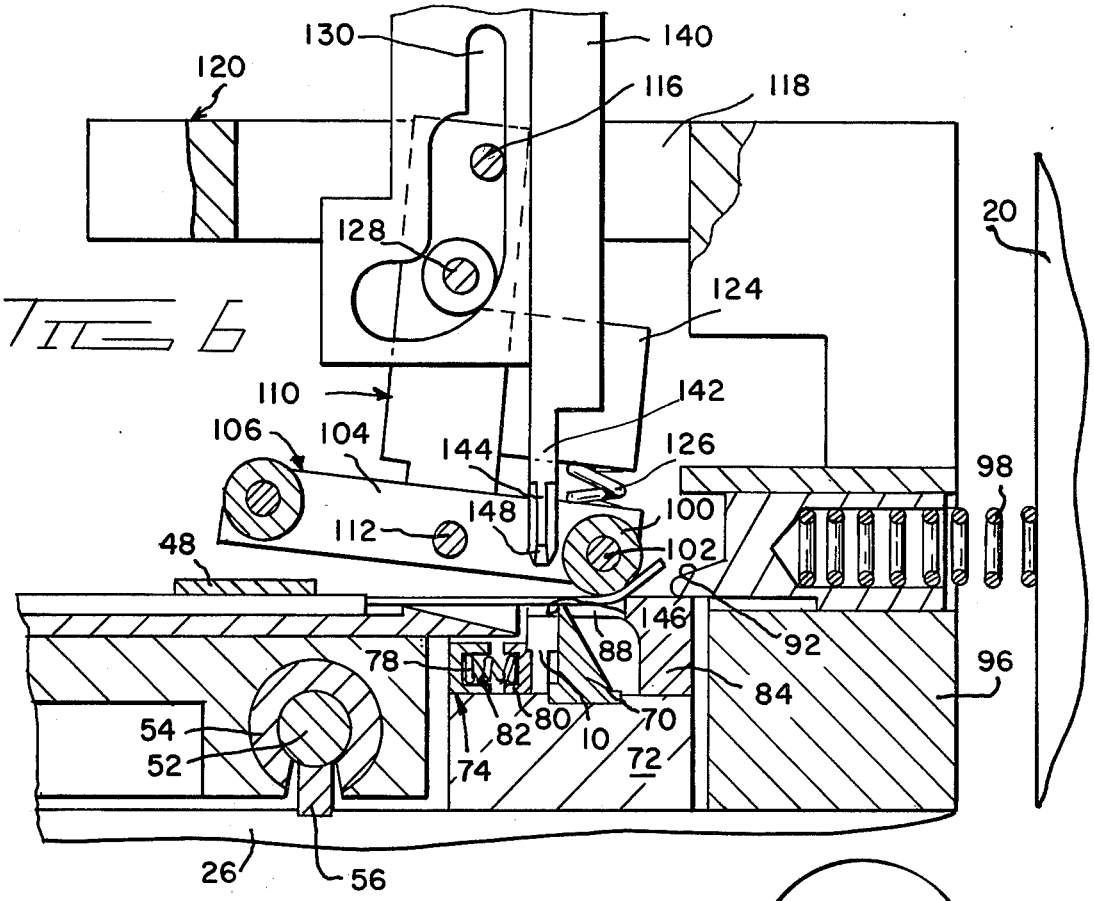
FIGS. 6 and 7 are views similar to FIG. 5 but showing the positions of the parts at successive stages of the cycle during insertion of the wire into a connector.
Figure 4A:
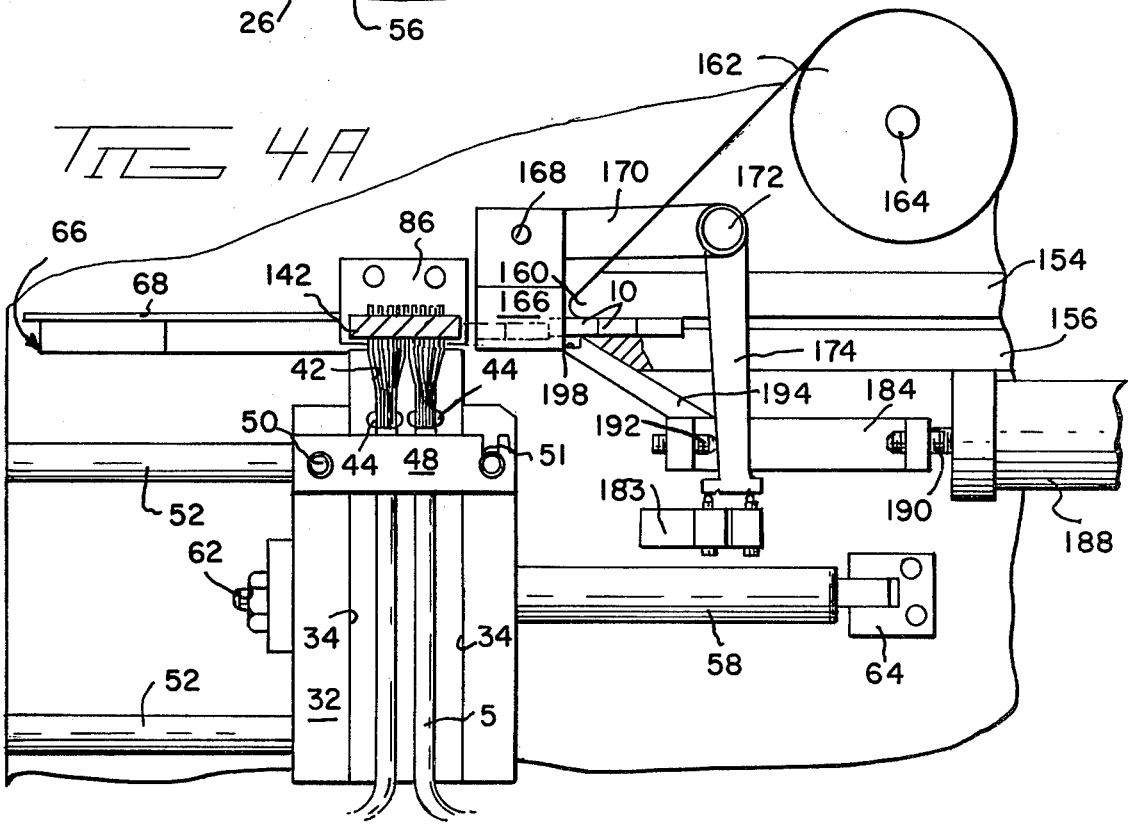
FIGS. 4A and 4B are views similar to FIG. 4, FIG. 4A showing the positions of the parts after descent of the ram and FIG. 4B showing the positions of the parts after return of the slide to the loading station and prior to removal of the cable.
Figure 7:
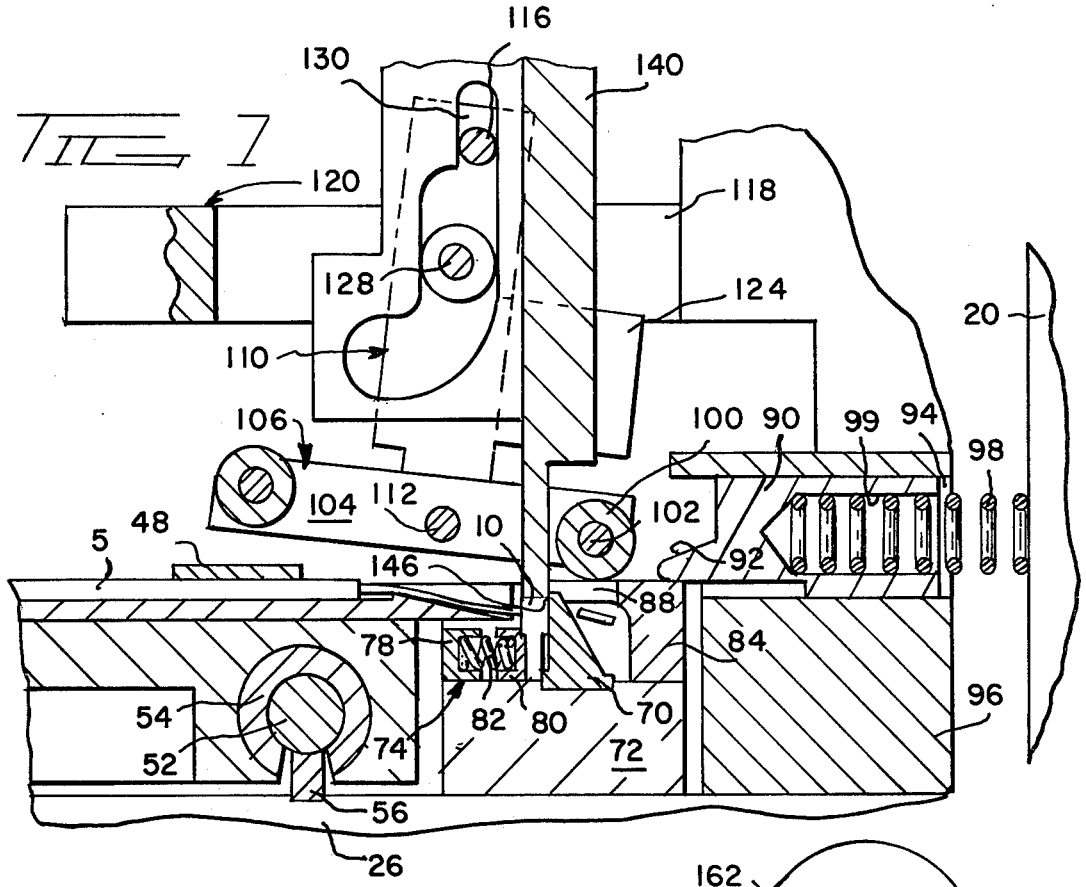
Figure 4B:
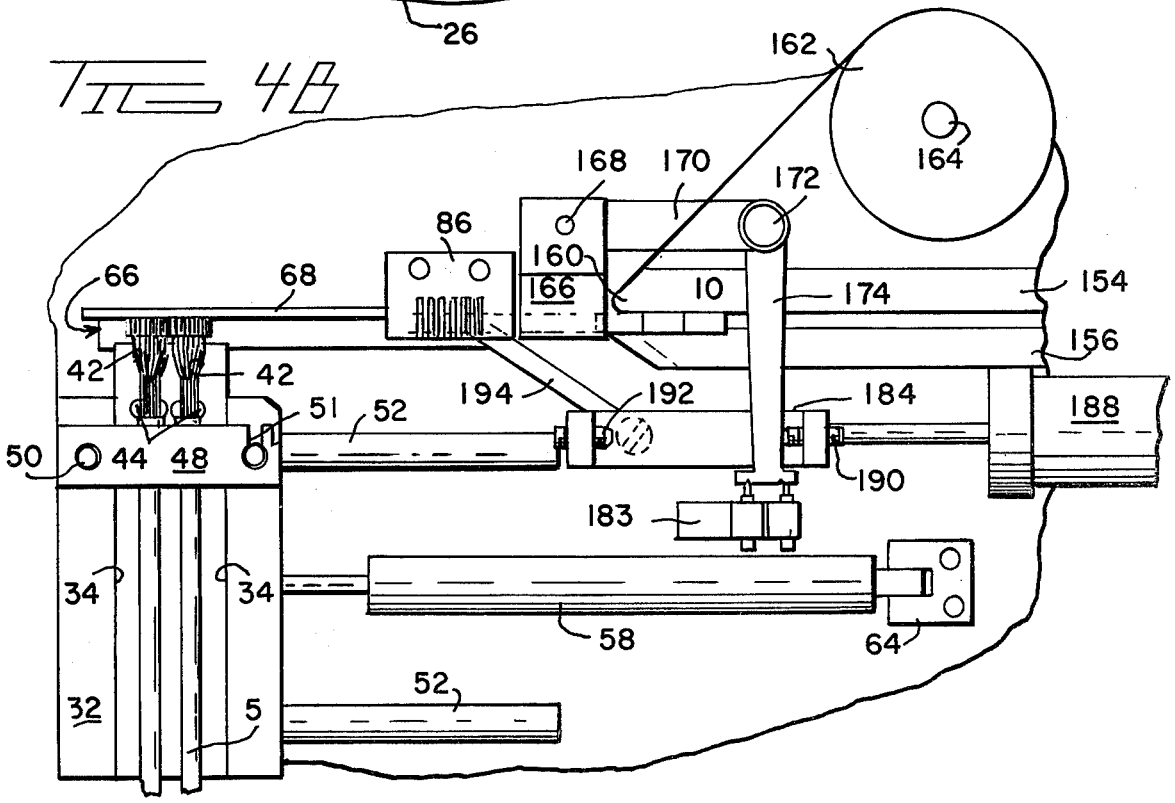

As shown in FIG. 6, by the time the cam follower enters the vertically extending portion 136 of the cam slot, the roller 100 will have rolled the wires into the recesses 40, 42 and into the slots 88 in the fixed templet block 84. The roller 100 will also have engaged a projection 91 on the controller and pushed the wire controller 90 rightwardly towards the press frame with the accompanying compression of the spring 98. The roller then dwells in the position of FIG. 7 and upon further downward movement of the press ram 24, the individual wires are trimmed and inserted into the terminals in the connectors by insertion punches 144 which extend from an reduced lower end portion 142 of an insertion punch block 140 mounted on the lower end of the ram. The inserters are shown as being integral with the block 140 but they can be clamped by fasteners to the block if desired. The individual punches 144 are dimensioned to move through the slots 88 and push the wires into the terminals and the right hand edge 148 of each punch as shown in FIG. 7 cooperates with one edge 146 of the positioning and shearing block 70 to trim the end portions of the wires. The scrap bits of wire then fall downwardly as viewed in FIG. 6 into the space separating the positioning and shearing block 70 and the fixed templet plate 84 and are removed by a vaccuum system which is described below.

As clearly shown in FIG. 7, the carrier 106 and the roller 100 are dimensioned such that the reduced lower end 142 of the punch block 140 can move downwardly from the position of FIG. 6 to the position of FIG. 7 while the roller dwells in the position of FIG. 7. The portion 136 of the camming slot in the camming block 132 provides a dwell interval sufficient for these further motions of the parts.

After the wires have been inserted into the terminals, the slide 30 is moved leftwardly from the position shown in FIG. 4 to the loading station, FIG. 3, and the connectors, with the wires attached thereto, are pulled leftwardly from beneath the fixed templet 84. The connectors move over an upwardly inclined camming ramp 150 which is provided on the upper surface of the previously identified camming block 66. A short horizontal surface 152 is provided at the end of this ramp 150 so that the two connectors on the ends of the cable are elevated above the surface of the templet 32. The operator then unclamps the cable by swinging the clamping bar 50 in a clockwise direction and he can then remove the completed terminated cable.

During each operating cycle, two connectors are fed to the insertion station by a feeding means which will now be described. The reel of connectors is mounted on a suitable spindle which is disposed rightwardly, as viewed in FIG. 3, of the operating zone and rightwardly of the support plate 26. The continuous tape having the connectors mounted thereon extends from the reel and extends between spaced-apart parallel guide blocks 154, 156 which are secured on the upper surface of an extension 158 of the previously identified block 72. The left hand end of the guide member 154 is contoured to provide a reversely extending guide surface 160 for the tape or belt 14 and the tape extends from this surface to a wind up spool 162 which is mounted on a vertically extending shaft 164. The wind up spool is driven by a low torque electrical motor mounted beneath the plate 26 and coupled to the shaft 164 by an over-running clutch, the arrangement being such that the tape will be wound on the spool as long as there is little or no tension in the tape but the clutch will over-run and permit the spool to remain stationary when such resistance is encountered and the tape is placed in tension.

This feed arrangement ensures that two connectors will be fed or pushed beyond the ends of the guide bars 154, 156 when the leading connector which would be located at the end 160 of the guide bar 154 does not encounter resistance. This condition will occur during each operating cycle when a U-shaped transfer slide 166 moves from the position it occupies in FIG. 3, the transfer slide having a passage extending therethrough which serves to guide two connector housings leftwardly and towards the insertion zone. The transfer slide 166 is slidably mounted and is pivoted by a pin-slot connection 168 to one arm 170 of a bell crank lever. The bell crank is pivoted to an extension 158 of base block 72 at 172 and has another arm 174 which extends forwardly towards the cylinder 58, see FIG. 3. The end of the arm 174 is enlarged as shown at 176 and is provided with two spaced-apart detent notches 178 which are dimensioned to receive the pointed ends of resiliently biased detent pins 180, 182 which, in turn, are mounted in a fixed mounting block 183 supported on the support plate 26. This arrangement provides for controlled movement of the bell crank and an extremely short stroke of the slide member 166 which moves between the positions shown in FIGS. 3 and 4.

The bell crank arm 174 extends past a control slide 184 which is secured to the end of the piston rod 186 of a piston cylinder 188. It will be apparent from the arrangement of the part shown in FIG. 3 that the slide 184 will be reciprocated rightwardly and leftwardly as viewed in FIG. 3 between the positions shown in FIGS. 3 and 4. This slide 184 serves to control oscillation of the bell crank by means of set screws 190, 192 which are threaded through upstanding end portions of the slide 184. When the piston rod 186 moves to its extended position, (FIG. 3) the screw 190 engages bell crank arm 174 and swings the bell crank through a slight clockwise arc, the limit of travel being precisely determined when the detent pin 182 enters the notch on the left in FIG. 3. When the parts move to the position of FIG. 3, the two leading connectors on the tape 14 will be pushed leftwardly as the tape is wound on the spool 162 and these two connectors will then be located within the U-shaped slide 166. FIG. 3 shows the positions of the parts after the feeding of these two connectors has taken place. When the slide 184 is retracted, that is, when it moves from the position of FIG. 3 to the position of FIG. 4, the set screw 192 will engage the bell crank arm 174 and cause the bell crank to swing through a slight counterclockwise arc so that the slide 166 will move forwardly from the position of FIG. 3 to the position of FIG. 4. This movement of the slide has the effect of transferring the two previously fed connectors laterally of the path of feed of the connector tape so that these two connectors which have been removed from the tape are placed in a position for the final feeding step during which they are fed leftwardly as viewed in FIG. 4 and are located beneath the fixed templet 84.

The two connectors 10 which are contained in the slide 66 are fed from the position of FIG. 4 to the insertion station beneath the fixed templet 84 by a feed arm 194 which is pivoted at 196 to the slide 184. The free end of this feed arm is notched as shown at 198 so that it can engage the corner of the second connector which is to be fed to the insertion zone when the slide 184 is retracted from the position of FIG. 2 to the position of FIG. 3. A small torsion spring is provided which biases this feed arm in a clockwise direction so that it is permitted to ride over the faces of the connectors on the opposite side from the faces 12 of the connector until the slide 184 reaches the rightward limit of its stroke (FIG. 4).

Figure 2:
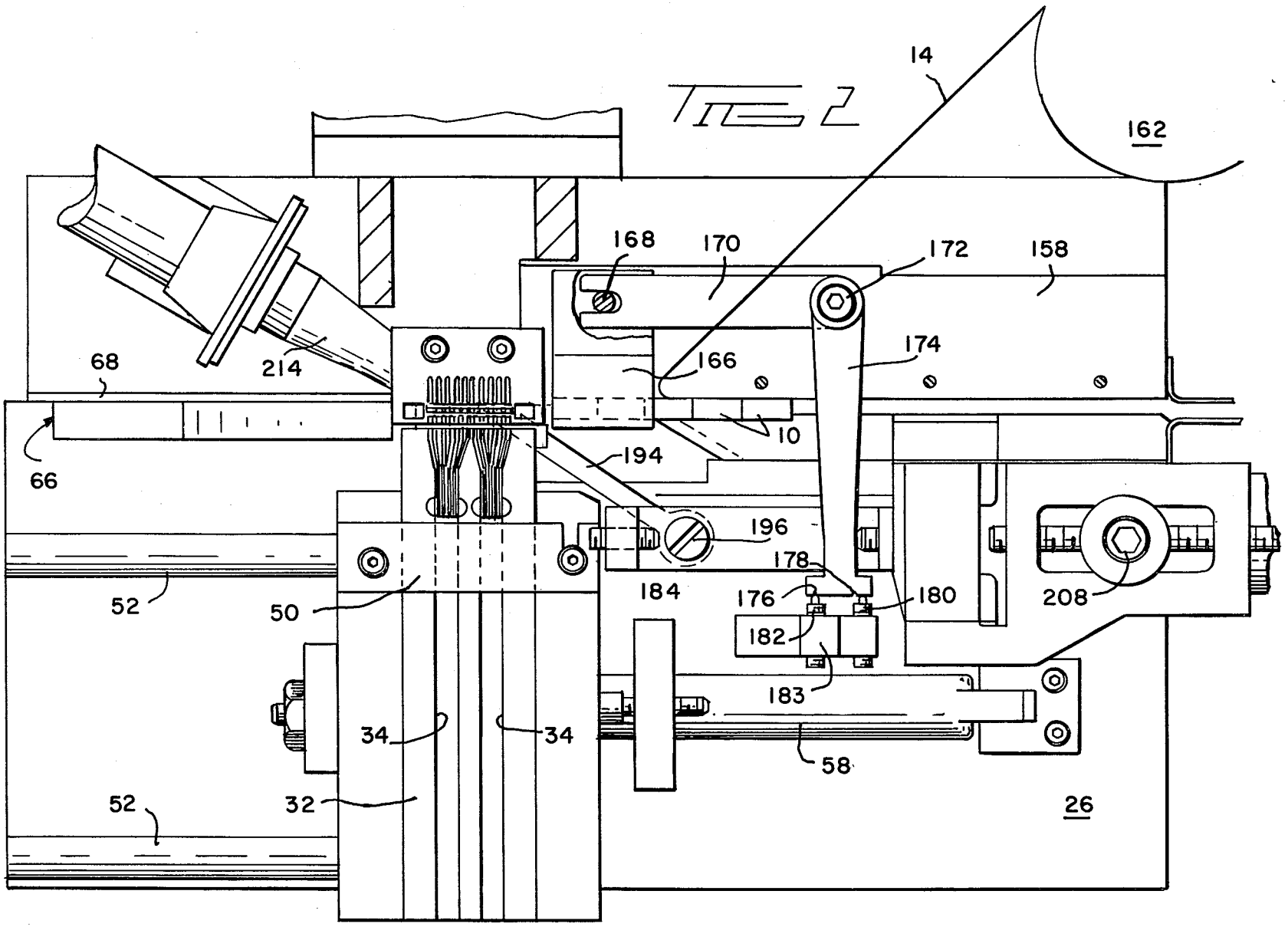
FIG. 2 is a plan view of the operating zone.

During leftward movement of the slide 184, the two connectors which are within the slide 166 in FIG. 2 are fed leftwardly until they are positioned beneath the fixed templet and are held in their proper position for the subsequent wire insertion operations.

It is desirable to provide a means for adjusting precisely the limits of the stroke of the slide 184 and this is done by mounting the cylinder 188 on a block 202 which is secured to the cylinder head 200. Block 202 is adjustably mounted on a block 204 by means of an adjusting screw 206, a suitable clamping device 208 being provided to clamp the adjusting screw in the desired position. The block 204 has an arm 210 on one side thereof which extends towards the insertion zone and an additional block 212 is secured to this arm by fasteners as shown. The block 212, in turn, extends from, and is secured to, the base block 72.

The operation of the disclosed embodiment is as follows. At the beginning of the operating cycle, the slide 30 will be located at the loading station and the press ram will be in its raised position relative to the insertion zone. The operator clamps the ends of a cable in the recess 34 of the templet plate 32 with the end of a cable jacketing disposed in the recesses 44 on the templet plate. The exposed ends of the wires will then extend beyond the end 38 of the templet plate and will rest upon the upper edge of the thin support plate 68. The operator then actuates the machine by a suitable electrical switch, not specifically shown, and the ensuing operations are entirely automatic. The slide member 30 first moves from the position of FIG. 1 to the position of FIG. 2 under the influence of the piston cylinder 58, 60. At the conclusion of such movement of the slide member, the wires will extend over the inclined surface 92 of the controller 90. The single revolution clutch of the press is then engaged to drive the ram 24 downwardly to its bottom dead center position and then return it to its raised position. During this stroke of the ram 24, the roller 100 is moved against the upper surface of the templet plate and the roller then rolls over the templet plate and over portions of the fixed templet plate 84. The controller 90 is moved rightwardly by the frame 106 against the compression of the spring 98. After the roller has passed the lower end of the insertion tooling on the insertion plate 140, the insertion punches 144 move downwardly behind the roller, trim the ends of the wires, and insert the wires into the terminals as shown in FIGS. 6 and 7. Thereafter, the ram returns to its raised position and the slide member 30 is returned to the loading station. During return of the slide member, the connectors which are now installed on the wires, slide upwardly over the inclined ramp surface 150 to the horizontal surface 152 of the camming plate 66. The operator then unclamps the cables and removes the cable assembly from the apparatus.

The actuation of the piston cylinders 58, 60 and 186, 188 may be brought about by suitable solenoid valves which are responsive to arrival of the slide member 30 at the insertion station. The engagement of the single revolution clutch can similarly be effected by a relay type control which is energized when the slide 30 arrives at the insertion station.

Figure 10:
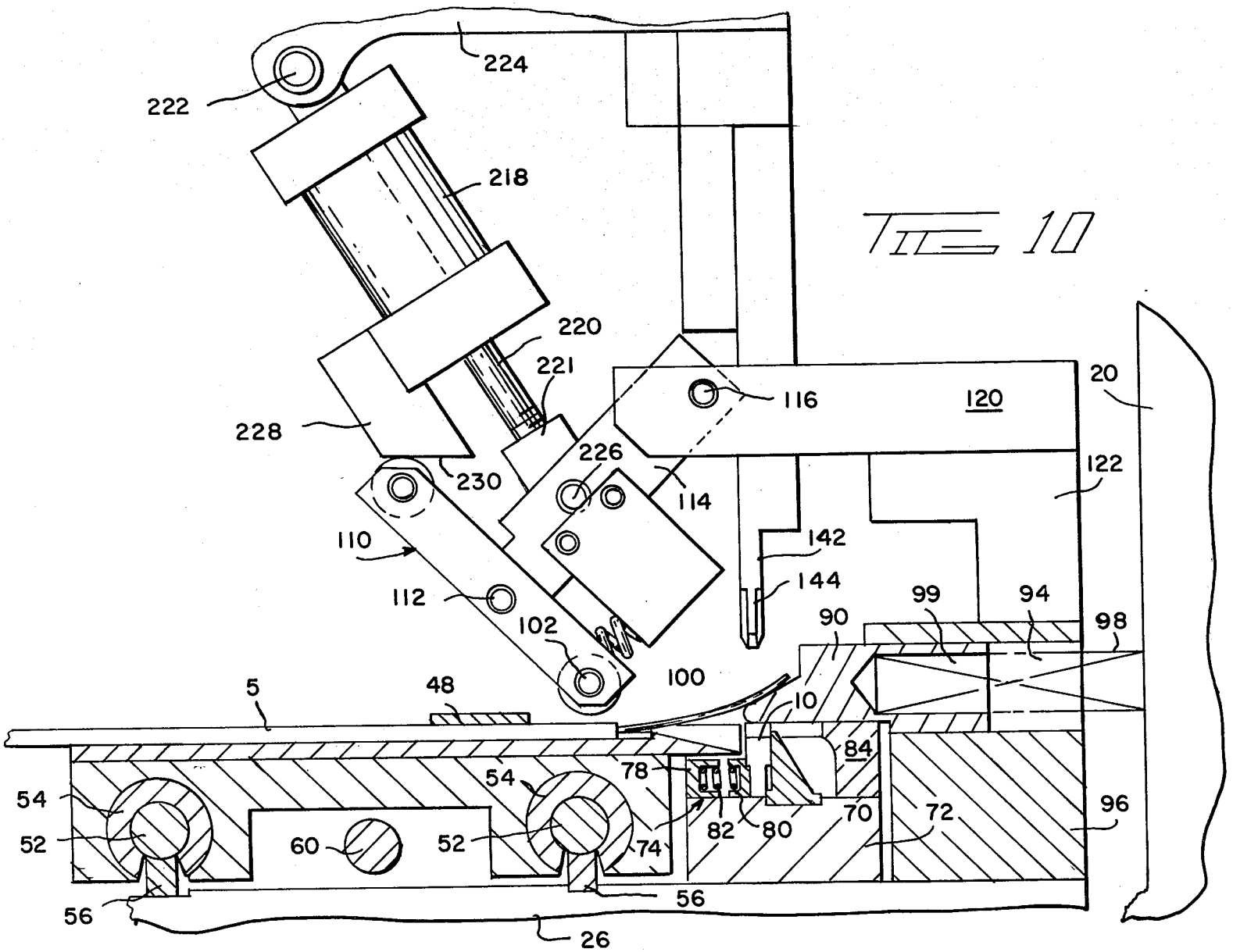
FIG. 10 is a view similar to FIG. 5 but showing an alternative embodiment.

FIG. 10 shows an alternative actuating means for the wire roller 100. The roller is mounted on the previously described carrier 106 which is mounted on the yoke 110 and the yoke 110 is pivoted at 116 to the frame arm 120 as also previously described. The actuating means in this embodiment comprises a piston-cylinder 218, 220, the cylinder member 220 being pivotally connected at 222 to an arm 224 which extends from the press frame. The piston rod 220 has a connecting block 221 on its end and this connecting block is pivoted at 226 to the arms 114 of the yoke 110. A block 228 is fixed to the lower head of the cylinder 218 and this block provides a bearing surface 230 for the roller 108 at the upper end of the carrier 106.

In use, the cylinder 218 is pressurized to drive the piston rod 220 outwardly of the cylinder so that the roller 100 is moved against the surface of the templet and caused to roll over the templet as illustrated in FIGS. 6 and 7. Thereafter, the press ram is moved downwardly and the insertion punches trim the wires and insert them into the wire-receiving portions of the terminals.

The arrangement shown in FIG. 10 obviates the need for the camming arrangement previously described for moving the wire pressing roller 100 across the templet. The camming arrangement has been successively employed, however, the cylinder actuator for the roller does provide an alternative means of operating this roller which may be preferable under some circumstances. Compressed air is supplied to, and exhausted from, the cylinder 218 by suitable valves which may be controlled by small switches in response to movement of the slide member 30 from the loading station to the insertion station and, during the final portion of the operating cycle, movement of the press ram from its bottom dead center position of FIG. 7 to its raised position. Thus the switch which controls the valve in supplying compressed air to the cylinder 18 can be located such that it will be closed by the slide member 30 upon arrival of the slide member at the insertion station and the switch which controls the valve system to exhaust the compressed air from the cylinder 218 can be located such that its condition is changed by the press ram upon arrival of the ram at its raised position.

It will be apparent from the foregoing description that many of the features of the disclosed embodiment can be used independently of other features. For example, the templet 32 can be designed such that it accepts only one end of a cable or that it accepts a plurality of discrete wires. The slide and templet arrangement can be used with alternative connector feeding arrangements or in machines which rely upon manual placement of the connectors in the insertion zone.

The disclosed embodiment of the invention incorporates a highly advantageous arrangement for controlling and locating the end portions of the wires 2 immediately prior to, and during, trimming of the wire ends and insertion of the trimmed ends into the wire-receiving portions 6 of the terminals in the connector 10. This feature of the invention is disclosed best in FIGS. 5–7. As shown in FIG. 5, after the slide 30 has arrived at the insertion station, the edge 38 of the wire supporting templet 32 will be adjacent to one side of the connector 10 and the ends of the cantilever arms 86 will be adjacent to the other side of the connector 10. The wires will extend from the surface of the templet 32 over the inclined surface 92 of the controller. After partial downward movement of the press ram, the roller 100 will have engaged the projections on the controller and moved it rightwardly to the position of FIG. 6 and the end portions of the wires will have been pressed into the recesses or slots 88 between the cantilever arms 86. At this stage of the operating cycle, portions of the wires will then extend across the gap between the shearing edge 146 and the edge of the wire supporting templet and the end portions of the wires will, moreover, be precisely located between grooves in the templet plate 32 and the slots or recesses 88. The portions of the wires which will later be placed or inserted into the terminals are thus precisely located at this stage of the operating cycle so that upon subsequent downward movement of the insertion punches 144, the wires will be trimmed and moved directly into the wire-receiving portions of the terminals without danger of their being misplaced in the connector. This feature of providing means on each side of the connector for holding the wires in alignment with the terminals can be used in alternative types of apparatus for installing connectors on the ends of cables.

What is claimed is:

1. Apparatus for inserting wires into the wire-receiving portions of electrical contact terminals which are contained in an electrical connector, said apparatus comprising:

an insertion zone, connector supporting means in said insertion zone for supporting an electrical connector, insertion punch means normally spaced from a connector supported on said supporting means, said insertion punch means being movable relatively towards and away from said connector, wire supporting slide means normally disposed at a loading station on one side of said insertion zone, said slide means being movable laterally from said loading station to an insertion station, said slide means having a wire supporting surface, said surface having one edge which is proximate to said insertion zone when said slide means is at said insertion station, wire positioning means effective to locate wires on said surface with end portions of said wires extending beyond said one edge and in spaced-apart relationship with the spacing between adjacent wires being the same as the spacing between said wire-receiving portions of said terminals, and actuating means effective to move said slide means from said loading station to said insertion station and thereafter move said insertion punch means towards, and then away from, said insertion zone whereby, upon placement of a connector on said connector supporting means, placement of said wires on said wire supporting slide means and actuation of said actuating means, said slide means moves to said insertion saation, said wires are positioned on said slide means with end portions of said wires in alignment with said wire-receiving portions of said terminals, and said end portions of said wires are inserted into said wire-receiving portions by said insertion punch means.

2. Apparatus as set forth in claim 1, said wire positioning means comprising wire-receiving grooves extending across said surface towards said one edge, and pressing means at said insertion station, said pressing means being movable across said surface towards said one edge to press said wires into said grooves.

3. Apparatus as set forth in claim 1 having connector feeding means for feeding connectors to said insertion zone.

4. Apparatus as set forth in claim 2 having a fixed wire guide templet in said insertion zone between said insertion punch means and said connector supporting means, said fixed templet having a free edge which extends beside said one edge of said slide means when said slide means is at said insertion station, said fixed templet having oppositely directed first and second surfaces, a plurality of wire guiding slots extending into said fixed templet from said one edge thereof and through said templet from said first surface to said second surface, said pressing means being movable across said first surface, said slots being dimensioned to receive end portions of said wires.

5. Apparatus as set forth in claim 4, said free edge of said fixed templet being spaced from said one edge of said slide means when said slide means is at said insertion station, said insertion punch means being movable between said free edge and said one edge.

6. Apparatus as set forth in claim 5 having fixed and movable shearing means for shearing wires adjacent to said free edge of said fixed wire guide templet, said fixed shearing means comprising fixed shearing edge means adjacent to said second surface, said movable shearing means comprising movable shearing edge means on said insertion punch means.

7. Apparatus as set forth in claim 4, having wire controller means, said wire controller means being normally disposed on said first surface of said fixed wire guide templet and in covering relationship to said wire guiding slots, said wire controller means having wire deflecting surface portions for deflecting portions of said wires away from said first surface, said wire controller means being movable in the direction of movement of said pressing means and in advance of said pressing means during movement of said pressing means across said first surface.

8. Apparatus for inserting wires into the wire-receiving portions of electrical contact terminals which are contained in an electrical connector, said apparatus comprising:

an insertion zone, connector supporting means in said insertion zone for supporting an electrical connector, insertion punch means normally spaced from a connector supported on said supporting means, said insertion punch means being movable relatively towards and away from said connector, wire supporting slide means normally disposed at a loading station on one side of said insertion zone, said slide means being movable laterally from one side of said loading station to an insertion station, said slide means having a wire supporting surface, said surface having one edge which is proximate to said insertion zone when said slide means is at said insertion station, wire positioning means effective to locate wires on said surface with end portions of said wires extending beyond said one edge and in spaced-apart relationship with the spacing between adjacent wires being the same as the spacing between said wire-receiving portions of said terminals, connector feeding means for feeding connectors laterally to said insertion zone from the side of said insertion zone which is opposite to said one side, connector ejecting means for moving a connector normally of, and past, said wire supporting surface during movement of said slide means from said insertion station to said loading station, and actuating means effective to move said slide means from said loading station to said insertion station and thereafter move said insertion punch means towards, and then away from, said insertion zone whereby, upon placement of a connector on said connector supporting means, placement of said wires on said wire supporting slide means and actuation of said actuating means, said slide means moves to said insertion station, said wires are positioned on said slide means with end portions of said wires in alignment with said wire-receiving portions of said terminals, said end portions of said wires are inserted into said wire-receiving portions by said insertion punch means, and upon movement of said slide means to said insertion station, said connector with said wires extending therefrom is ejected from said apparatus.

9. Apparatus as set forth in claim 8, said ejecting means comprising static camming means, said connector being movable over said static camming means during movement of said slide means from said insertion station to said loading station.

10. In an apparatus for inserting wires into the wire-receiving portions of electrical contact terminals which are contained in an electrical connector, said apparatus having connector supporting means for supporting said connector in a predetermined position, insertion punch means normally spaced from a connector supported in said supporting means and movable relatively towards and away from said connector, a wire supporting templet having one edge which is proximate to a connector in said connector supporting means, wire locating grooves extending across said templet towards said one edge, said grooves being spaced-apart at said one edge by distances corresponding to the spacing between said terminals in said connector in said supporting means, and wire pressing means movable across said templet for pressing said wires into said grooves, the improvement comprising:

a fixed wire guide templet adjacent to said connector in said supporting means, said fixed templet having a free edge which extends parallel to said one edge of said wire supporting templet and which is spaced from said one edge, said guide templet having a plurality of wire guiding slots extending inwardly from said one edge, said slots being in alignment with said wire locating grooves, said insertion punch means being movable between said one edge and said free edge, a wire controller means normally disposed on said fixed wire guide templet and in covering relationship to said wire guiding slots, said controller having wire deflecting surface portions for deflecting portions of said wires away from said fixed guide templet, said pressing means being movable across said wire supporting templet and said fixed templet and being engageable with said controller means to move said controller across said fixed templet whereby, upon positioning said wires on said wire supporting templet and thereafter moving said pressing means across said wire supporting templet and across said fixed guide templet, said wires are located in said grooves and said pressing means moves said controller away from said free edge, and end portions of said wires are located in said grooves, and upon subsequent movement of said inserting means towards a connector in said connector supporting means, portions of said wires which extend between said one edge and said fixed edge are moved towards said connector and into said wire-receiving portions of said terminals.

11. Apparatus as set forth in claim 10 having fixed and movable shearing means for trimming end portions of said wires concomitantly with insertion of said wires into said wire-receiving portions, said fixed shearing means comprising a shearing edge extending beside a connector in said connector supporting means, said movable shearing means comprising shearing edge means on said insertion punch means and movable past said fixed shearing edge means.

12. Apparatus as set forth in claim 11, said apparatus having a slide member which is movable between a loading station and insertion station, said slide member having said wire supporting templet thereon, said insertion station being in the position of said slide member when said one edge is proximate to a connector in said connector supporting means whereby, said wires can be positioned on said wire supporting templet at said loading station and upon subsequent movement of said slide member to said insertion station, said wires can be pressed into said grooves by said pressing member and thereafter trimmed and inserted into said wire-receiving portions of said terminals.

13. Apparatus as set forth in claim 12, said apparatus including a press having a press ram, said insertion punch means being on said press ram and said connector supporting means being beneath said press ram, said loading station being disposed laterally relative to the stroke of said ram from said insertion station.

* * * * *